US007032714B2

(12) United States Patent
Wang

(10) Patent No.: US 7,032,714 B2
(45) Date of Patent: Apr. 25, 2006

(54) AUTOMATIC RETURN MECHANISM FOR ELEVATOR ESCAPE DEVICE

(76) Inventor: Jiun Jyh Wang, No.50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 282 days.

(21) Appl. No.: 10/752,046

(22) Filed: Jan. 5, 2004

(65) Prior Publication Data

US 2005/0145441 A1 Jul. 7, 2005

(51) Int. Cl.

| | |
|---|---|
| ***B66B 1/02*** | (2006.01) |
| ***B66B 11/08*** | (2006.01) |
| ***B66B 1/06*** | (2006.01) |
| ***B66B 13/14*** | (2006.01) |

(52) U.S. Cl. ..... 187/311; 187/263; 187/298; 187/314

(58) Field of Classification Search ..... 187/263, 187/298, 311, 314

See application file for complete search history.

(56) References Cited

U.S. PATENT DOCUMENTS 1,232,438 A * 7/1917 Spitzfaden ..... 187/314
3,212,607 A * 10/1965 Smith ..... 187/314
5,368,131 A * 11/1994 Yoshihiro ..... 187/301
6,273,216 B1 * 8/2001 Kocher et al. ..... 187/377
6,464,043 B1 * 10/2002 Wang ..... 187/314
6,561,318 B1 * 5/2003 Lamb ..... 187/263
6,739,431 B1 * 5/2004 Wang ..... 187/306

FOREIGN PATENT DOCUMENTS

JP 03133888 A * 6/1991

* cited by examiner

*Primary Examiner*—Kathy Matecki
*Assistant Examiner*—Eric E. Pico
(74) *Attorney, Agent, or Firm*—Pro-Techtor Int'l Services

(57) ABSTRACT

Disclosed is a return mechanism for elevator escape device. The return mechanism mounted at a wall of a car and comprises a drive sheave, upper and lower secondary sheaves, a wheel coaxially disposed with the drive sheave and located on an inner wall of the car, a lever including a lower pivot end, a positioning bar, an upper end at the drive sheave, and a groove, a link having one end defined by the groove and a roller at the other end, a support for permitting the link to slide therethrough, a catch, and projecting return members. In a case of car failure, a trapped passenger is able to continuously rotate the wheel for escape in which the mechanism can automatically return to its original position by moving the link backward after the roller contacting the return member.

4 Claims, 8 Drawing Sheets

FIG, 6
PRIOR ART

AUTOMATIC RETURN MECHANISM FOR ELEVATOR ESCAPE DEVICE

BACKGROUND OF THE INVENTION

1. Field of the Invention

The present invention relates to escape devices of elevator and more particularly to a mechanism which can cause an elevator escape device to automatically return to its normal position after passengers trapped in a malfunctioned car (e.g., due to power outage) have made a successful escape by lowering or hoisting the car to be flush with a floor by operating the escape device.

2. Description of Related Art

A conventional elevator escape device 70 is shown in FIGS. 6, 7, and 8. In a case of car failure, a drive sheave 40 is moved to a position between two opposite secondary sheaves 30 and interengaged therewith by rotating a first handle 44 by a trapped passenger to cause a lever 41 to move along an arcuate groove 64 until the lever 41 reaches a hooked portion 65 at one end of the groove 64 and is locked therein. Next, the passenger can grasp a second handle 43 to rotate a wheel 42 and thus the drive sheave 40. The rope 10 then is activated to run downward along the grooved rims of the drive sheave 40 and the secondary sheaves 30. In response, the escape device 70 is activated to lower or hoist a car 20 until the car 20 reaches a safe position for passenger(s) escape.

However, the prior art suffered from a disadvantage. For example, the lever 41 is not unlocked even after the failure has been fixed. As such, a brake of the car 20 may be still disabled after the elevator has begun a normal operation due to, for example, the restoration of power. This can cause the car 20 to lower rapidly due to the unbalanced counterweight. This is very dangerous. For solving this problem, a manual movement of the lever 41 by a maintenance technician to return to its normal position is required after the car failure has been fixed. This is inconvenient. Hence, a need for improvement exists.

SUMMARY OF THE INVENTION

It is an object of the present invention to provide a return mechanism for an escape device of an elevator, the return mechanism mounted at a wall of a car, comprising a drive sheave; upper and lower secondary sheaves; a rope extended from the escape device to be disposed between the drive sheave and the secondary sheaves; a wheel coaxially disposed with the drive sheave and located on an inner wall of the car; a lever including a lower pivot end, a positioning bar proximate the pivot end, an upper end rotatably coupled to the drive sheave, and a longitudinal groove in about intermediate portion of the lever; a link including a pin end defined by the groove and a roller at the other end, the link being substantially perpendicular to the lever; a support sleeved on a portion of the link so as to permit the link to slide therethrough; a catch disposed proximate an open end of the positioning bar; and a plurality of projecting return members disposed along a vertical opening, each return member being allotted to a unique floor, wherein in a case of car failure, a trapped passenger is able to continuously rotate the wheel and thus the drive sheave, the lever is activated to pivot about the pivot end to move the drive sheave to a position between the secondary sheaves and interengage the drive sheave therewith, the rope is activated to run downward along the drive sheave and the secondary sheaves, the escape device is activated to lower or hoist the car, the link moves toward the return member, the positioning bar moves into the catch for being locked therein, the movement of the car is stopped once the roller contacts the return member, and the roller immediately moves backward until the positioning bar is clear from the catch, the drive sheave is not engaged with both the secondary sheaves, and the rope is located between the drive sheave and the secondary sheaves.

It is another object of the present invention to provide a return mechanism for an escape device of an elevator, the return mechanism mounted at a wall of a car, comprising a drive sheave; upper and lower secondary sheaves; a rope extended from the escape device to be disposed between the drive sheave and the secondary sheaves; a wheel coaxially disposed with the drive sheave and located on an inner wall of the car; a lever including a lower pivot end, a positioning bar proximate the pivot end, the positioning bar including an elongated trough, an upper end rotatably coupled to the drive sheave, and a longitudinal groove in about intermediate portion of the lever; a link including a pin end defined by the groove, a latched member on a surface, and a roller at the other end, the link being substantially perpendicular to the lever; an actuator including a shaft having an upper end defined by the trough; a limit switch disposed proximate the link; a push button disposed on the inner wall of the car; a support sleeved on a portion of the link so as to permit the link to slide therethrough; and a plurality of projecting return members disposed along a vertical opening, each return member being allotted to a unique floor, wherein in a case of car failure, a trapped passenger is able to press the push button to activate the actuator for pulling down the shaft, the lever is activated to pivot about the pivot end to move the drive sheave to a position between the secondary sheaves and interengage the drive sheave therewith, the rope is activated to run downward along the drive sheave and the secondary sheaves, the escape device is activated to lower or hoist the car, the link moves toward the return member, the movement of the car is stopped once the roller contacts the return member, and the roller immediately moves backward until the latched member contacts the limit switch for deactivating the actuator with the link being adapted to pivot backward to return both the drive sheave and the rope to their non-operating position.

The above and other objects, features and advantages of the present invention will become apparent from the following detailed description taken with the accompanying drawings.

DETAILED DESCRIPTION OF THE PREFERRED EMBODIMENTS

Figure 1:
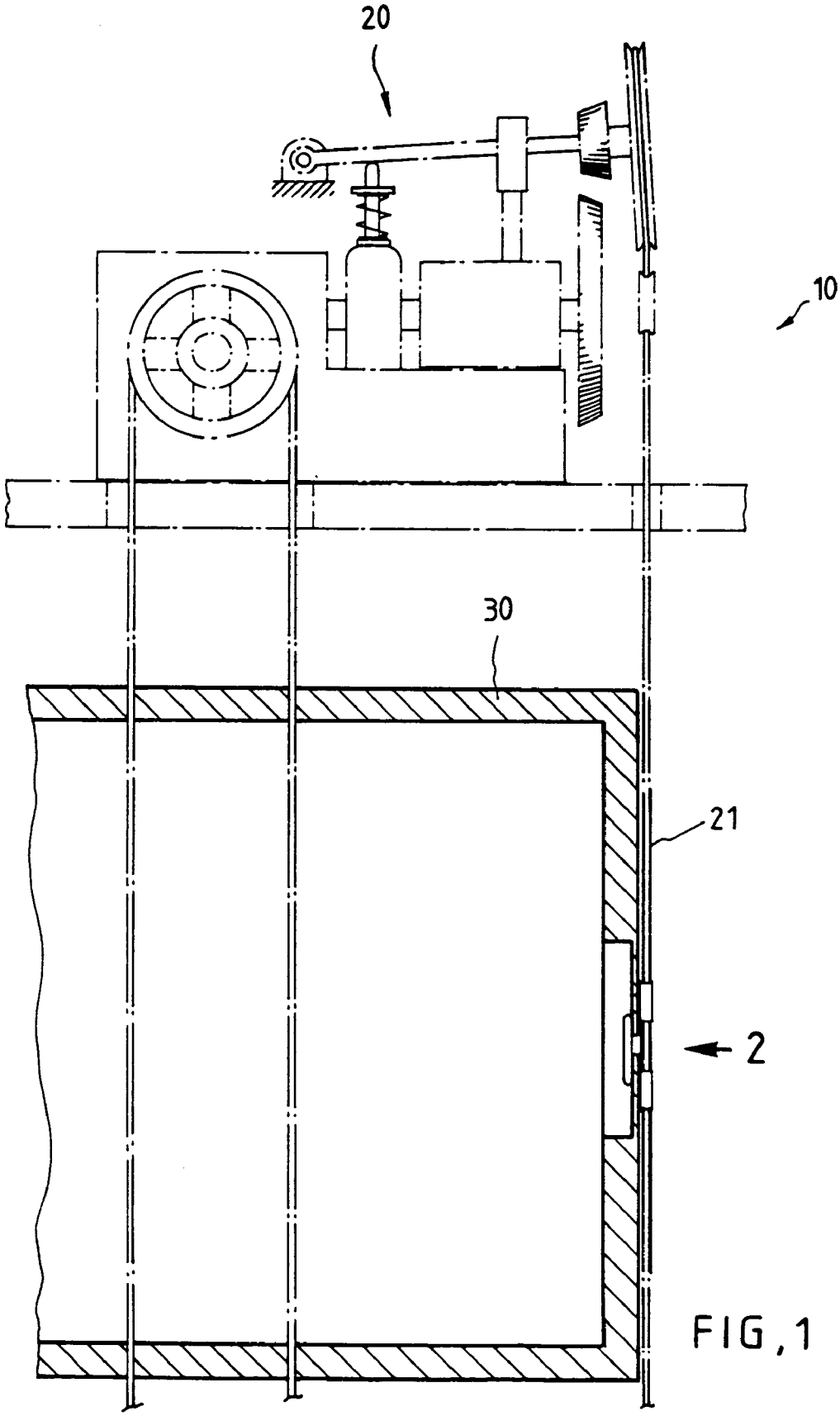
FIG. 1 is a plan view in part section showing an arrangement of machine room and elevator car according to the invention.
Figure 2:
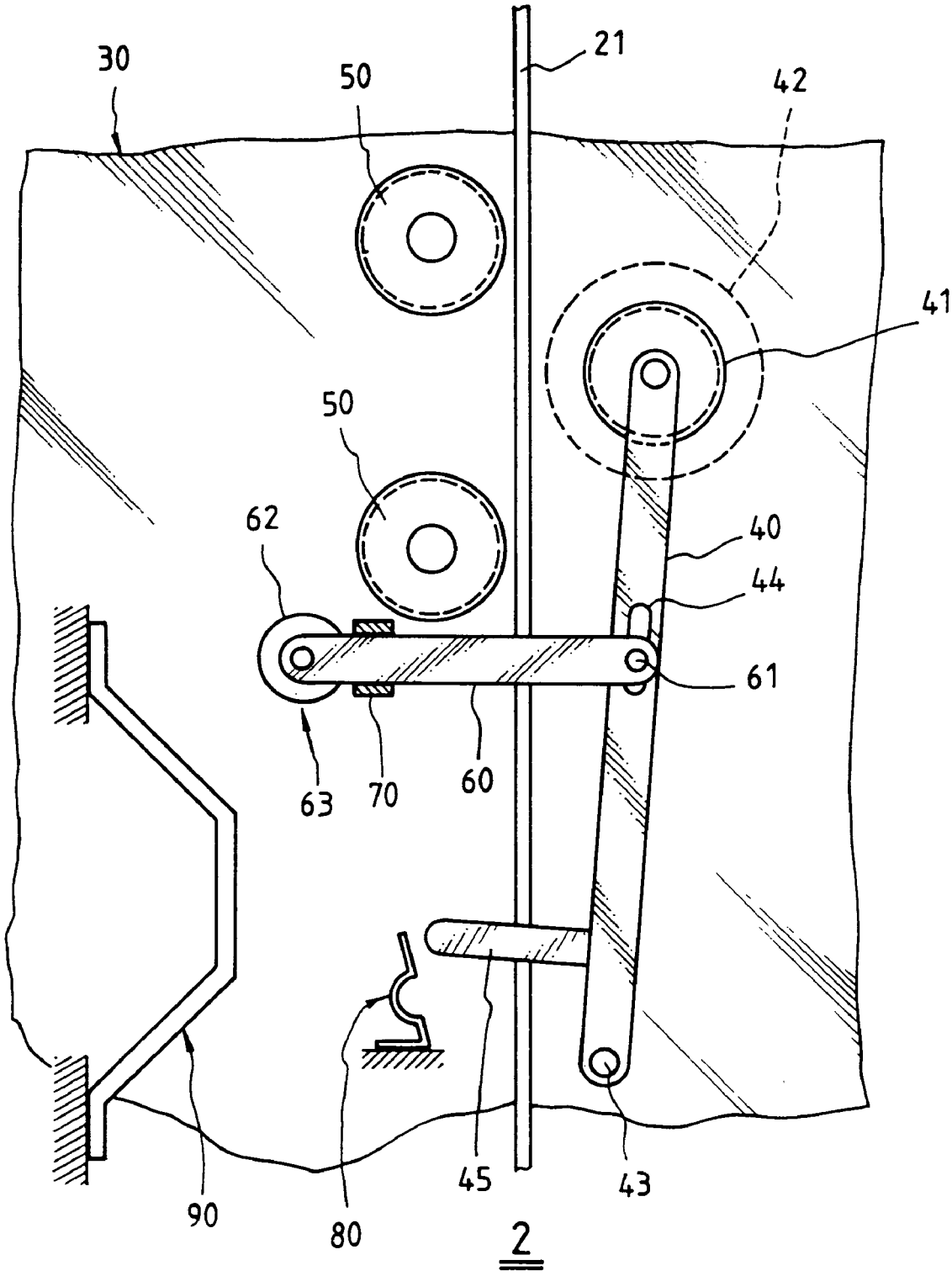
FIG. 2 is a plan view of a first preferred embodiment of automatic return mechanism for an elevator escape device according to the invention.

Referring to FIGS. 1 and 2, a first preferred embodiment in accordance with the invention is shown. An escape device 20 is installed in a machine room 10 of an elevator. A return mechanism 2 is provided at a wall of a car 30. A rope 21 is extended from the escape device 20 to the return mechanism 2 and is between a drive sheave 41 at one side and upper and lower secondary sheaves 50 at the other side. A wheel 42 is coaxially disposed with the drive sheave 41 and is located on the inner wall of the car 30. A lever 40 comprises a lower pivot end 43, a positioning bar 45 proximate the pivot end 43, an upper end rotatably coupled to the shaft of the drive sheave 41, and a longitudinal groove 44 in the intermediate portion of the lever 40. A link 60 has a pin end 61 defined by the groove 44 and the other end 63 formed as a roller 62. The link 60 is about perpendicular to the lever 40. A support 70 is sleeved on a portion of the link 60 and the link 60 is slidable through the support 70. A catch 80 is provided proximate an open end of the positioning bar 45. A plurality of projecting return members 90 are provided along a vertical shaft and each of them is allotted to a different floor. Alternatively, each return member 90 is allotted to a predetermined number of floors.

Figure 3:
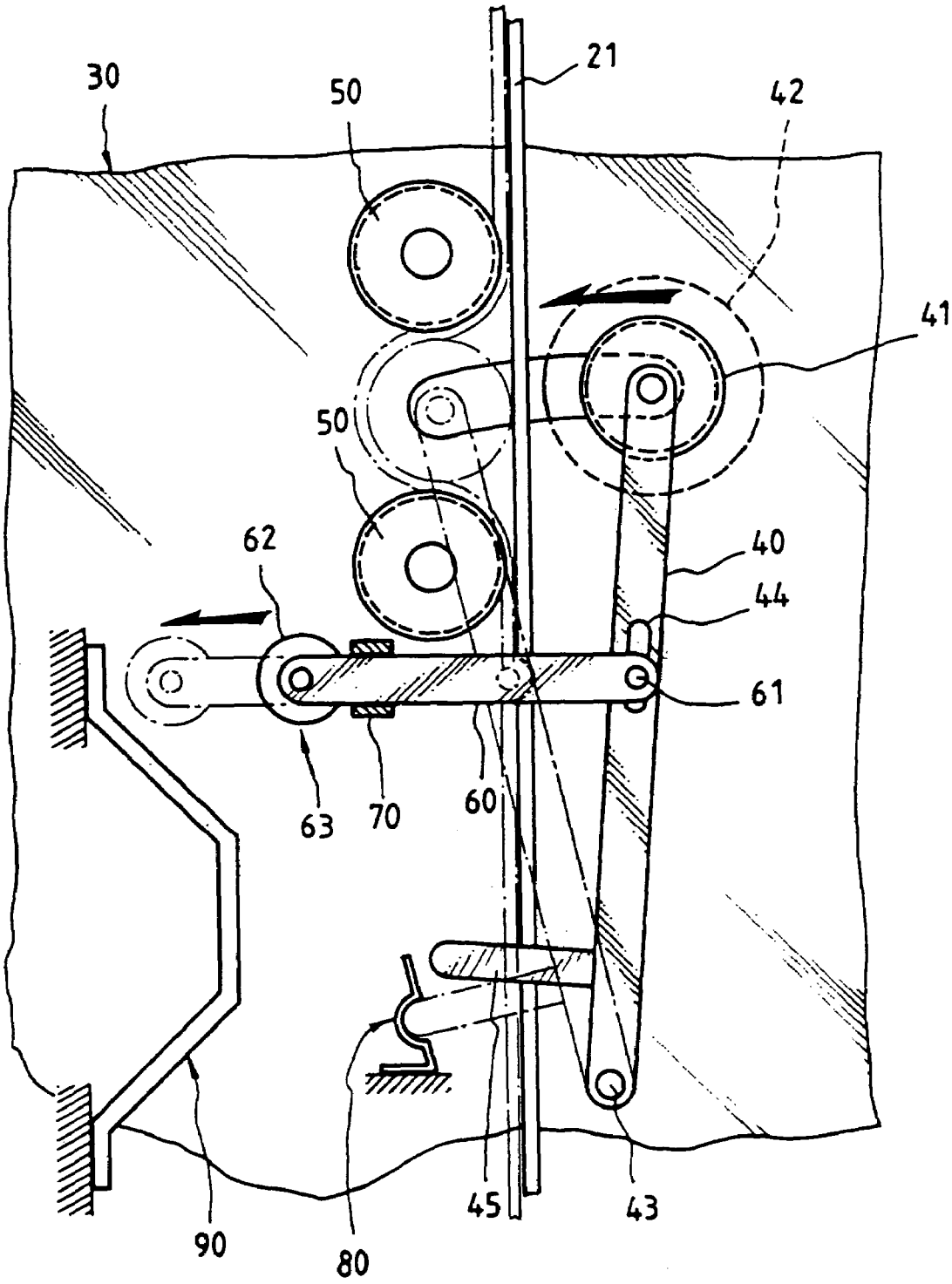
FIG. 3 is a view similar to FIG. 2, where the return mechanism is operating to activate the escape device.
Figure 4:
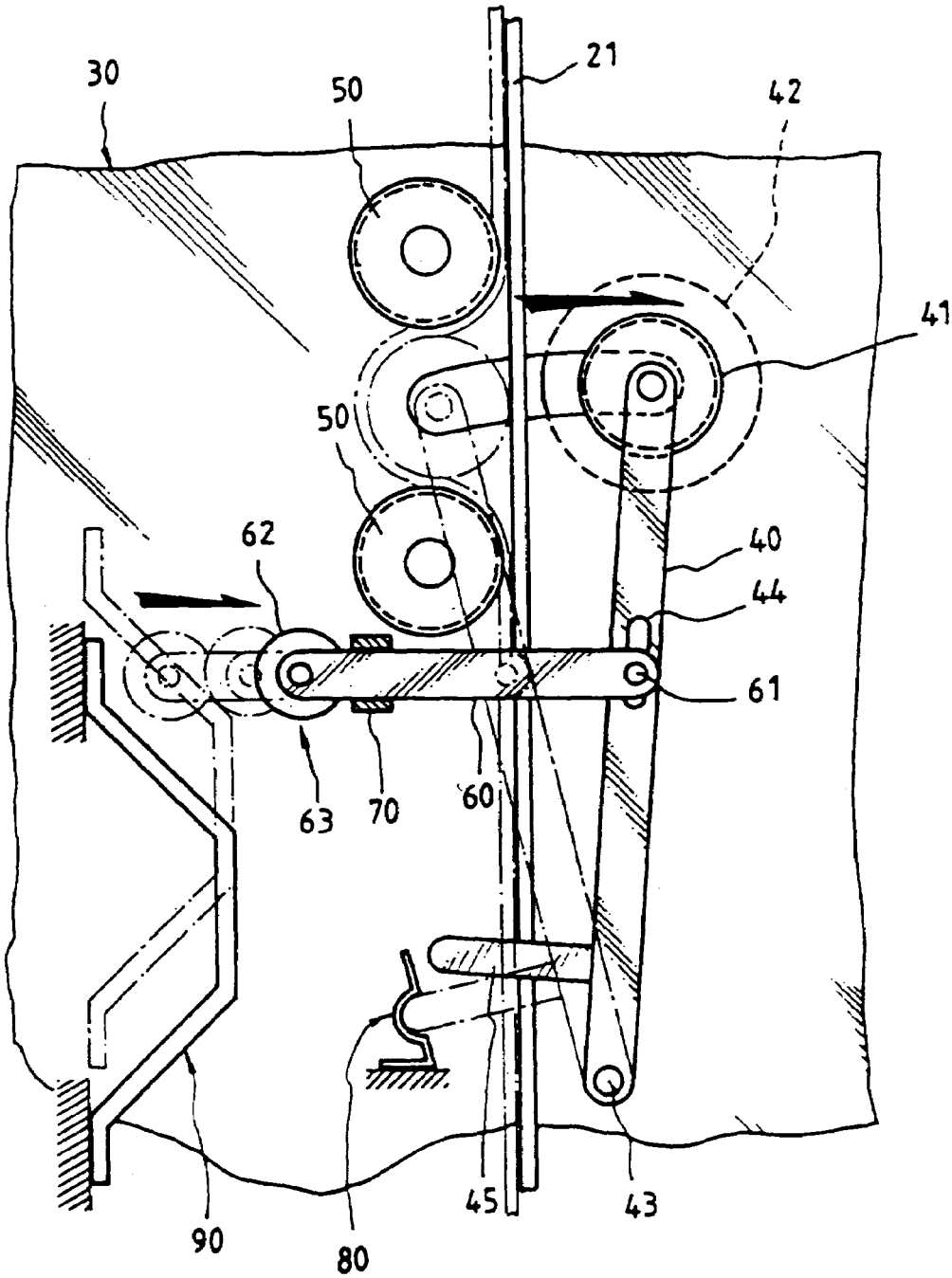
FIG. 4 is a view similar to FIG. 2, where the return mechanism is operating to return to its normal position shown in FIG. 2.
Figure 5:
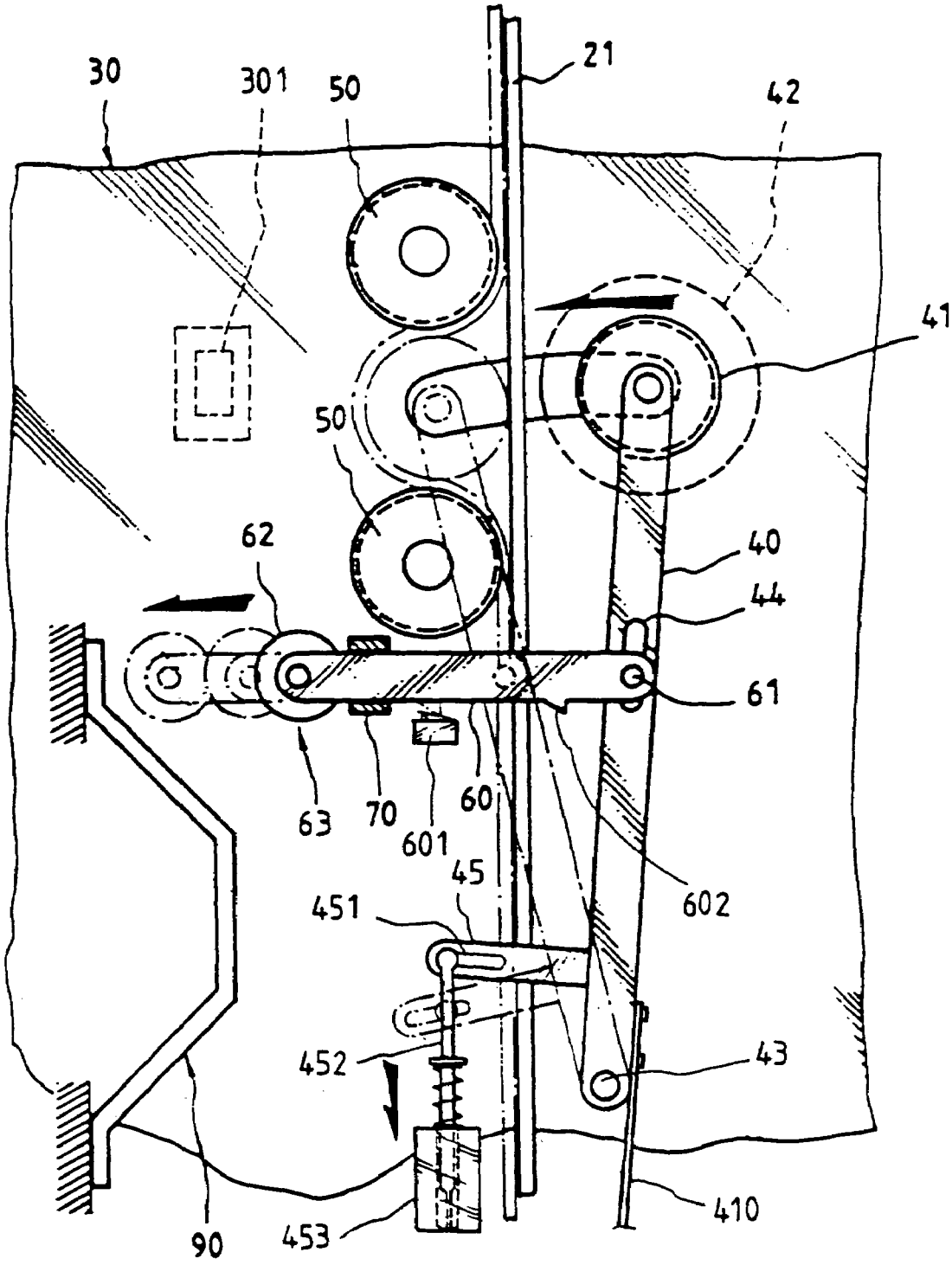
FIG. 5 is a plan view of a second preferred embodiment of automatic return mechanism for elevator escape device according to the invention, where the return mechanism is operating to activate the escape device.
Figure 6:
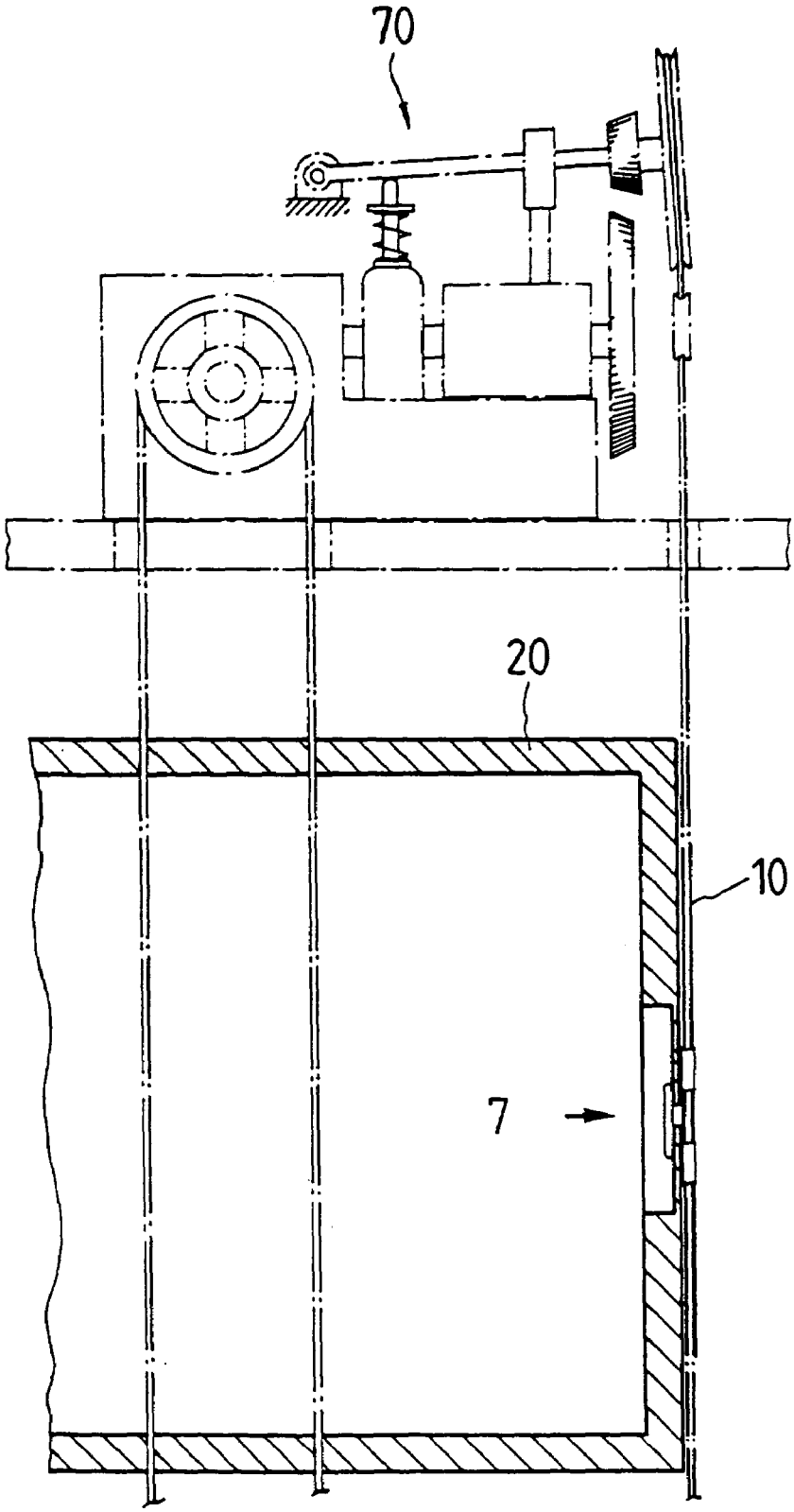
FIG. 6 is a plan view in part section showing a conventional arrangement of machine room and elevator car.
Figure 7:
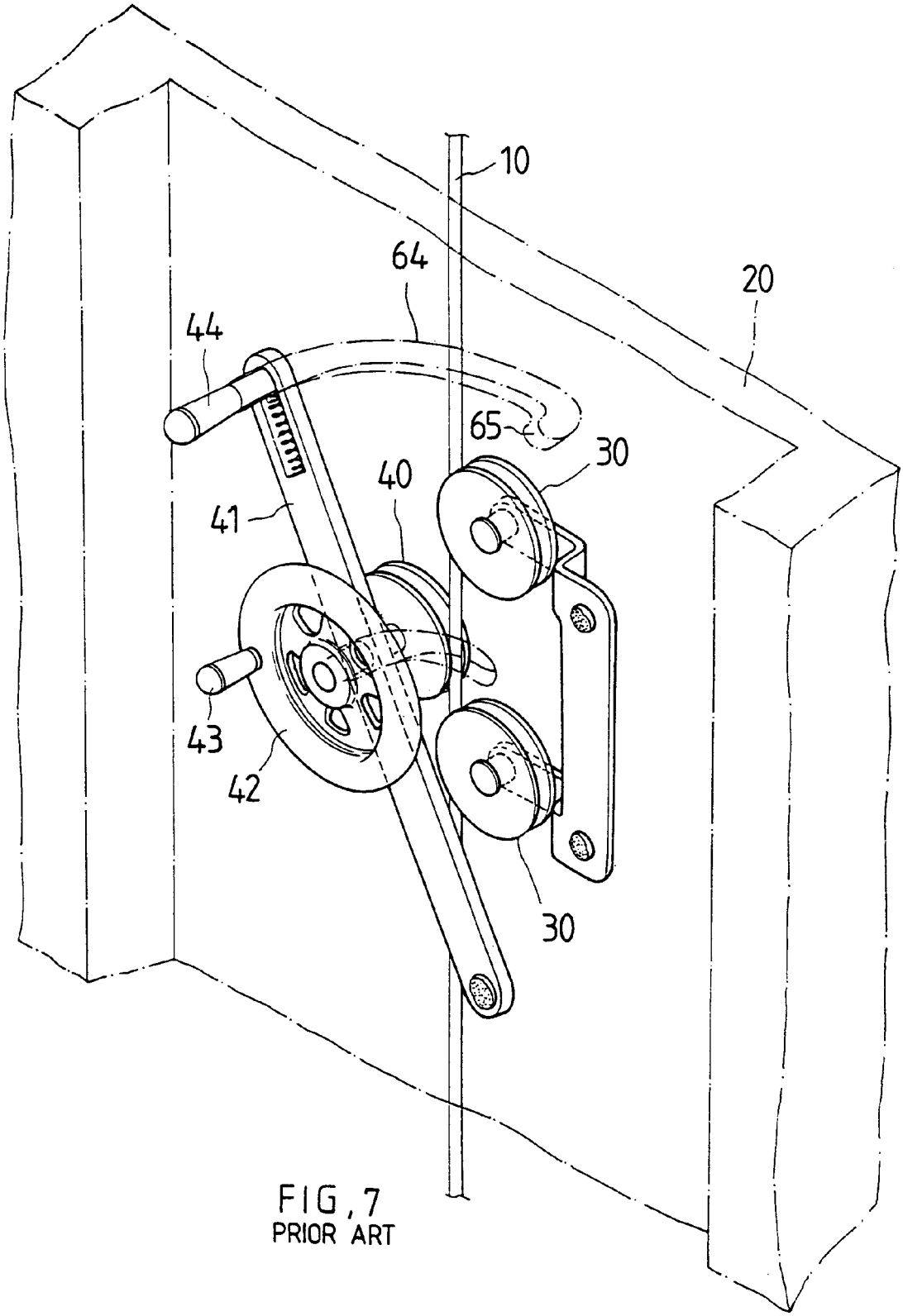
FIG. 7 PRIOR ART
FIG. 7 is a perspective view of a conventional elevator escape device.
Figure 8:
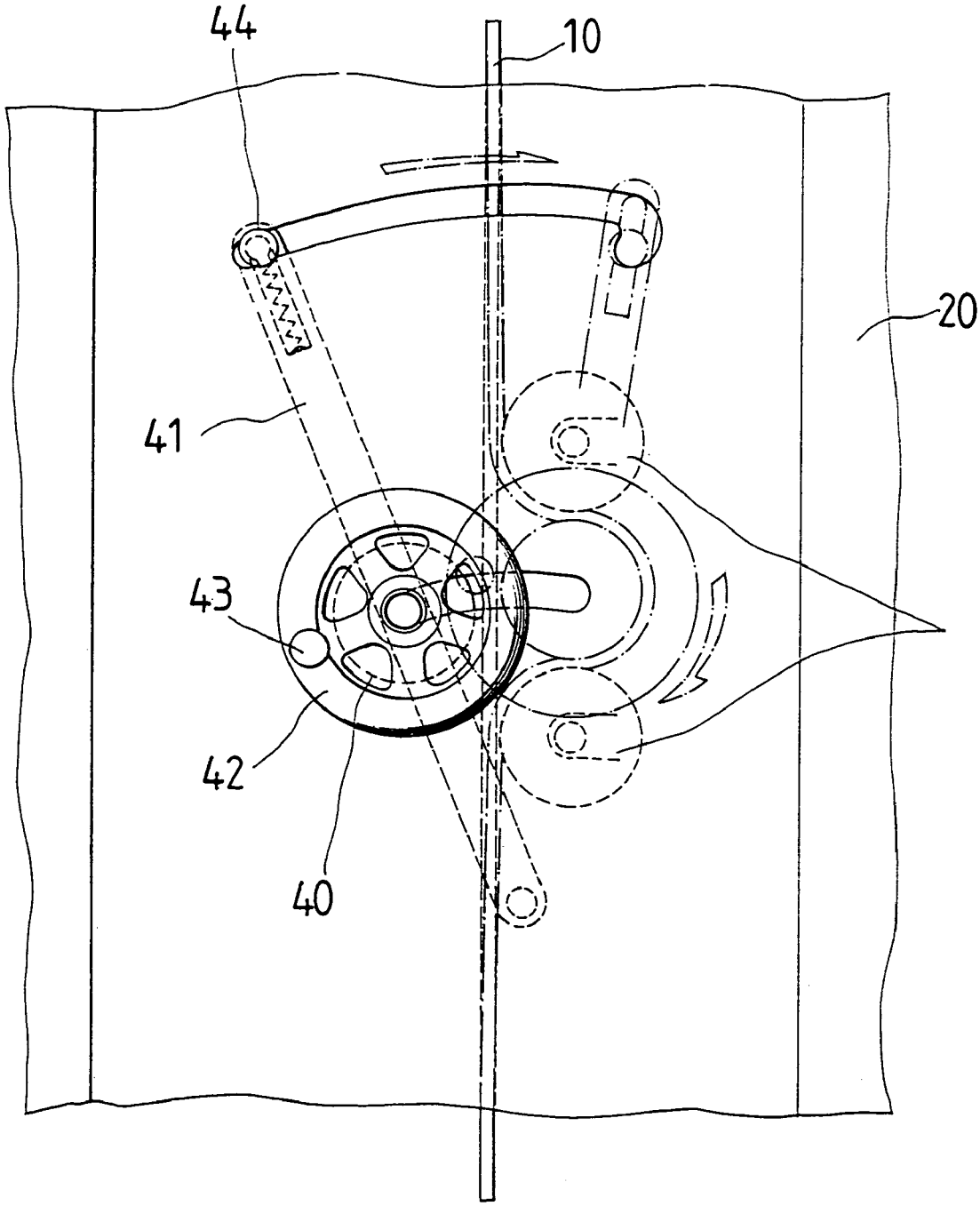
FIG. 8 PRIOR ART
FIG. 8 is a front plan view illustrating an operation of the return mechanism of FIG. 7 for activating the car to help trapped passenger(s) escape therefrom.

Referring to FIGS. 3 and 4, escape operation of the escape device 20 and return operation of the return mechanism 2 will now be described in detail below. In a case of car failure (e.g., due to power outage), a trapped passenger can continuously rotate the wheel 42 and thus the drive sheave 41. Hence, the lever 40 is activated to pivot about the pivot end 43 so as to move the drive sheave 41 to a position between the secondary sheaves 50 and interengage the drive sheave 41 therewith. As such, the rope 21 runs downward along the grooved rims of the drive sheave 41 and the secondary sheaves 50. In response, the escape device 20 is activated to lower or hoist the car 30. At the same time, the roller 62 moves toward the return member 90 as the pin end 61 in the groove 44 moves toward the support 70 due to the transverse movement of the lever 40. Also, the positioning bar 45 moves into the catch 80 for being locked therein. The lowering or hoisting movement of the car 30 will be stopped once the roller 62 contacts the return member 90. At this time, the car 30 reaches a safe floor for allowing passenger(s) to escape. Once the roller 62 contacts the return member 90, the roller 62 will move backward, i.e., the return member 90 is served as a turning point. The backward movement of the link 60 will continue until the return mechanism 2 returns to its original position, i.e., the positioning bar 45 is clear from the catch 80, the drive sheave 41 is not engaged with both the secondary sheaves 50, and the rope 21 is located between the drive sheave 41 and the secondary sheaves 50 (see FIG. 2). Hence, a brake of the car 30 is still activated after the elevator begins its normal operation because power has been restored. This is a safe arrangement.

Referring to FIG. 4, there is shown a second preferred embodiment of the invention. The second preferred embodiment is particularly designed for the handicapped or the like. The characteristics of the second preferred embodiment are detailed below. An elongated trough 451 is provided adjacent the open end of the positioning bar 45. A shaft 452 of an electromagnetic actuator 453 has an upper end defined by the trough 451. The actuator 453 is operated by backup power. A limit switch 601 is provided proximate one side of the link 60. The link 60 further comprises a latched member 602. A push button 301 is provided on the inner wall of the car 30. In a case of car failure (e.g., due to power outage), a trapped passenger (e.g., a handicapped person) can press the push button 301 to turn on the backup power for activating the actuator 453 in order to pull the shaft 452 downward. As such, the lever 40 pivots about the pivot end 43 so as to move the drive sheave 41 to a position between the secondary sheaves 50 and interengage the drive sheave 41 therewith. Also, the rope 21 runs downward along the grooved rims of the drive sheave 41 and the secondary sheaves 50. In response, the escape device 20 is activated to lower or hoist the car 30. At the same time, the roller 62 moves toward the return member 90 as the pin end 61 in the groove 44 moves toward the support 70 due to the transverse movement of the lever 40. The lowering or hoisting movement of the car 30 will be stopped once the roller 62 contacts the return member 90. At this time, the car 30 reaches a safe floor for allowing passenger(s) to escape. Once the roller 62 contacts the return member 90, the roller 62 will move backward. The latched member 602 will contact the limit switch 601 for deactivating the actuator 453 during the backward movement. Eventually, the return mechanism 2 returns to its original position, i.e., the drive sheave 41 is not engaged with both the secondary sheaves 50, and the rope 21 is located between the drive sheave 41 and the secondary sheaves 50 (see FIG. 2).

While the invention herein disclosed has been described by means of specific embodiments, numerous modifications and variations could be made thereto by those skilled in the art without departing from the scope and spirit of the invention set forth in the claims.

What is claimed is:

1. A return mechanism for an escape device of an elevator, the return mechanism mounted at a wall of a car, comprising:

a drive sheave;

upper and lower secondary sheaves;

a rope extended from the escape device to be disposed between the drive sheave and the secondary sheaves;

a wheel coaxially disposed with the drive sheave and located on an inner wall of the car;

a lever including a lower pivot end, a positioning bar proximate the pivot end, an upper end rotatably coupled to the drive sheave, and a longitudinal groove in about intermediate portion of the lever;

a link including a pin end defined by the groove and a roller at the other end, the link being substantially perpendicular to the lever;

a support sleeved on a portion of the link so as to permit the link to slide therethrough;

a catch disposed proximate an open end of the positioning bar; and a plurality of projecting return members disposed along a vertical opening, each return member being allotted to a unique floor, wherein in a case of car failure, a trapped passenger is able to continuously rotate the wheel and thus the drive sheave, the lever is activated to pivot about the pivot end to move the drive sheave to a position between the secondary sheaves and interengage the drive sheave therewith, the rope is activated to run downward along the drive sheave and the secondary sheaves, the escape device is activated to lower or hoist the car, the link moves toward the return member, the positioning bar moves into the catch for being locked therein, the movement of the car is stopped once the roller contacts the return member, and the roller immediately moves backward until the positioning bar is clear from the catch, the drive sheave is not engaged with both the secondary sheaves, and the rope is located between the drive sheave and the secondary sheaves.

2. A return mechanism for an escape device of an elevator, the return mechanism mounted at a wall of a car, comprising:

a drive sheave;

upper and lower secondary sheaves;

a rope extended from the escape device to be disposed between the drive sheave and the secondary sheaves;

a wheel coaxially disposed with the drive sheave and located on an inner wall of the car;

a lever including a lower pivot end, a positioning bar proximate the pivot end, the positioning bar including an elongated trough, an upper end rotatably coupled to the drive sheave, and a longitudinal groove in about intermediate portion of the lever;

a link including a pin end defined by the groove, a latched member on a surface, and a roller at the other end, the link being substantially perpendicular to the lever;

an actuator including a shaft having an upper end defined by the trough;

a limit switch disposed proximate the link;

a push button disposed on the inner wall of the car;

a support sleeved on a portion of the link so as to permit the link to slide therethrough; and a plurality of projecting return members disposed along a vertical opening, each return member being allotted to a unique floor, wherein in a case of car failure, a trapped passenger is able to press the push button to activate the actuator for pulling down the shaft, the lever is activated to pivot about the pivot end to move the drive sheave to a position between the secondary sheaves and interengage the drive sheave therewith, the rope is activated to run downward along the drive sheave and the secondary sheaves, the escape device is activated to lower or hoist the car, the link moves toward the return member, the movement of the car is stopped once the roller contacts the return member, and the roller immediately moves backward until the latched member contacts the limit switch for deactivating the actuator with the link being adapted to pivot backward to return both the drive sheave and the rope to their non-operating position.

3. The return mechanism of claim 2, wherein the actuator is an electromagnetic actuator.

4. The return mechanism of claim 3, wherein the electromagnetic actuator is operated by a backup power supply.

* * * * *